US010801174B2

(12) United States Patent
Bruce et al.

(10) Patent No.: US 10,801,174 B2
(45) **Date of Patent: *Oct. 13, 2020**

(54) COLLAR AND ANCHOR KITS

(71) Applicant: Hubbell Incorporated, Shelton, CT (US)

(72) Inventors: David Alan Bruce, Oakland, FL (US); Andrew Ervin Pendergrast, Centralia, MO (US); Jason Wayne Herron, Mexico, MO (US); Page Haacke, Timonium, MD (US)

(73) Assignee: HUBBELL INCORPORATED, Shelton, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/248,562

(22) Filed: Jan. 15, 2019

(65) Prior Publication Data

US 2019/0145075 A1 May 16, 2019

Related U.S. Application Data

(63) Continuation of application No. 15/638,053, filed on Jun. 29, 2017, now Pat. No. 10,184,222.

(60) Provisional application No. 62/356,270, filed on Jun. 29, 2016.

(51) Int. Cl.

| | |
|---|---|
| ***E02D 5/54*** | (2006.01) |
| ***E02D 5/52*** | (2006.01) |
| ***E02D 5/28*** | (2006.01) |
| ***B28B 21/02*** | (2006.01) |
| ***E02D 5/38*** | (2006.01) |
| ***E02D 5/50*** | (2006.01) |
| ***E02D 7/22*** | (2006.01) |
| *E02D 5/30* | (2006.01) |

(52) U.S. Cl.

CPC ..... *E02D 5/526* (2013.01); *B28B 21/02* (2013.01); *E02D 5/285* (2013.01); *E02D 5/385* (2013.01); *E02D 5/50* (2013.01); *E02D 5/54* (2013.01); *E02D 7/22* (2013.01); *E02D 5/30* (2013.01)

(58) Field of Classification Search

CPC E02D 5/526; E02D 5/385; E02D 5/54; E02D 5/50; E02D 5/30; E02D 7/22; B28B 21/02

See application file for complete search history.

(56) References Cited

U.S. PATENT DOCUMENTS

| | | | | |
|---|---|---|---|---|
| 1,647,925 | A | 11/1927 | May | |
| 3,193,059 | A | 7/1965 | Wallerstein | |
| 3,512,327 | A | 5/1970 | Padura | |
| 3,653,168 | A | 4/1972 | Cook | |
| 3,813,837 | A | 6/1974 | McClain | |
| 3,922,413 | A | 11/1975 | Reinman | |
| 4,186,536 | A * | 2/1980 | Piazza | E04C 2/284 264/279 |

(Continued)

OTHER PUBLICATIONS

International Search Report and Written Opinion mailed in PCT/US17/40088 dated Sep. 15, 2017.

*Primary Examiner* — Benjamin F Fiorello
(74) *Attorney, Agent, or Firm* — Wissing Miller LLP

(57) ABSTRACT

Precast collars for screw type anchors that have a body made of a high strength composite or concrete material. The body having an opening to receive an anchor base head portion of an anchor so that a structure to be supported by the anchor is in direct contact with the anchor.

20 Claims, 20 Drawing Sheets

(56) References Cited

U.S. PATENT DOCUMENTS

| | | | | |
|---|---|---|---|---|
| 4,283,162 | A | 8/1981 | Parker | |
| 4,295,308 | A | 10/1981 | Korfanta | |
| 4,505,449 | A * | 3/1985 | Turner | F16M 5/00 248/346.03 |
| 4,580,795 | A | 4/1986 | Burtelson | |
| 4,779,389 | A | 10/1988 | Landers | |
| 4,785,593 | A | 11/1988 | Munoz, Jr. | |
| 4,920,715 | A | 5/1990 | Parsons | |
| 5,039,256 | A | 8/1991 | Gagliano | |
| 5,065,975 | A | 11/1991 | Giles | |
| 5,143,472 | A | 9/1992 | Reed et al. | |
| 5,240,528 | A * | 8/1993 | Pagni | A47B 13/00 156/63 |
| 5,243,795 | A | 9/1993 | Roberts | |
| 5,625,988 | A | 5/1997 | Killick | |
| 5,944,452 | A | 8/1999 | Reinert | |
| 6,044,604 | A | 4/2000 | Clayton | |
| 6,050,539 | A * | 4/2000 | Millen | F16M 5/00 248/678 |
| 6,176,055 | B1 | 1/2001 | Fu | |
| 6,722,821 | B1 | 4/2004 | Perko | |
| 7,004,683 | B1 | 2/2006 | Rupiper | |
| 7,377,723 | B2 | 5/2008 | Nolan | |
| 7,416,367 | B2 | 8/2008 | St. Onge | |
| 8,522,503 | B1 | 9/2013 | Egan, Jr. | |
| 9,051,706 | B1 | 6/2015 | Ludwig | |
| 9,284,710 | B2 | 3/2016 | Nyce | |
| 9,850,638 | B2 | 12/2017 | Despotellis | |
| 10,184,222 | B2 * | 1/2019 | Bruce | B28B 21/02 |
| 2013/0266409 | A1 * | 10/2013 | Van Wormer | B65F 1/141 414/408 |
| 2015/0330031 | A1 | 11/2015 | Van Erp | |

* cited by examiner

COLLAR AND ANCHOR KITS

CROSS REFERENCE TO RELATED APPLICATIONS

This application is a continuation of application Ser. No. 15/638,053 filed Jun. 27, 2017 (now U.S. Pat. No. 10,184,222), and claims benefit from U.S. Provisional Application Ser. No. 62/356,270 filed Jun. 29, 2016 the contents of both are incorporated herein in their entirety by reference.

BACKGROUND

Field

The present disclosure relates generally to collars for anchors and to anchor kits, and more particularly, to helical pile anchors with precast collars providing an aesthetically pleasing junction between the anchors and the structures being supported by the anchors.

Description of the Related Art

Street, highway, area or parking lot lighting is typically installed on a concrete base where a hole is bored into the ground, a cylindrical form is placed into the hole and concrete is poured into the form. In many instances, a portion of the concrete base extends above grade so that it is visible. The street light or parking lot light has a long pole which is secured to the concrete base. Creating the concrete base, allowing the concrete base to set, and then installing the light pole often takes time which increases the cost to install each light pole.

One way to reduce the time and thus the cost to install street light poles, highway light poles, area light poles or parking lot light poles is to use screw type anchors, such as helical piles, which are a cost-effective alternative to conventional cement piles because of the speed and ease at which a helical pile can be installed. Helical piles are rotated such that load bearing helical plates at the lower end of the pile effectively screw the pile into the soil to a desired depth. Helical piles are installed by applying torque to a shaft that causes the load bearing helical plates to rotate and screw into the soil with minimal disruption to the surrounding soil. However, if a portion of the helical pile that connects to the light pole extends above grade the finish between the pile and the structure it is supporting often is not aesthetically pleasing.

SUMMARY

The present disclosure provides embodiments of precast collars for anchors and anchor kits for supporting structures, such as street light poles, highway light poles, area light poles and parking lot light poles. In one exemplary embodiment, the collar has a body made of a high strength natural limestone sand based composite with a foam core or a polymer concrete. The body has an opening for receiving at least a portion of a screw type anchor. In another embodiment, the collar has a body made of a high strength natural limestone sand based composite with a foam core and a central opening capable of receiving a head portion of an anchor base such that the collar carries no load from a structure supported by an anchor. In one exemplary embodiment, the anchor kit includes a screw type anchor and a collar similar to the collars described above.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Exemplary embodiments of the present disclosure represent cost effective improvements to the anchoring of structures to the ground with decorative or non-decorative precast collars at the junction between the anchor and the structure. Structures the anchor can support include, for example, street light poles, highway light poles, area light poles and parking lot light poles. However, the present disclosure is not limited to such structures.

Figure 1:
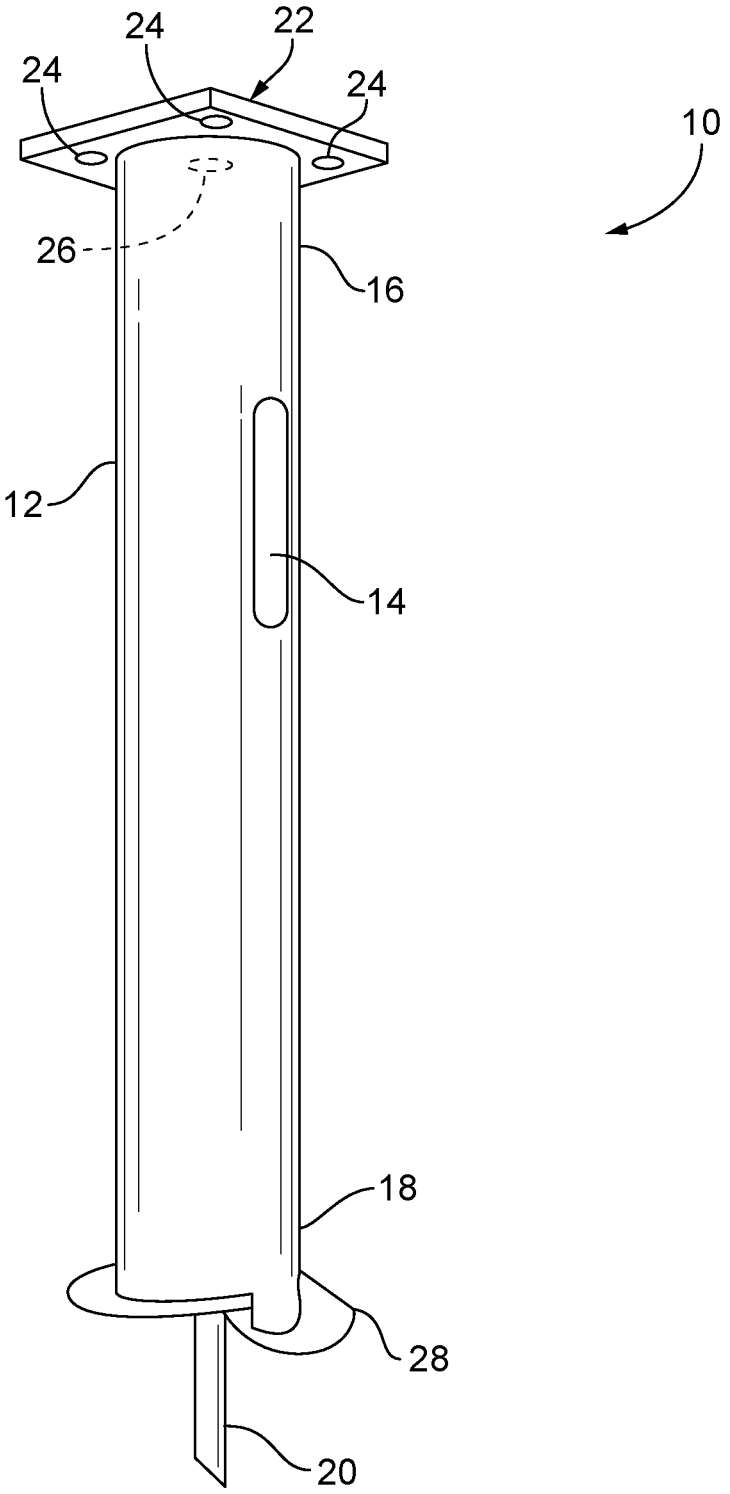
FIG. 1 is a side perspective view of an exemplary embodiment of an anchor for supporting a structure.

Referring now to the figures, in particular FIG. 1, an exemplary embodiment of an anchor according to the present disclosure is shown. In this exemplary embodiment, the anchor 10 is a helical pile anchor having an anchor base 12 which is typically a straight pipe, tube or shaft that may be round or square in shape, or any other shape, such as a hexagon shape. In embodiments where the anchor base is hollow, a portion of the length of the anchor base 12 may include an opening 14 for passing, for example, electrical wires through the anchor base.

The anchor base 12 is fabricated from a rigid material capable of supporting the particular load the anchor is intended to support. Examples of suitable rigid materials include steel, galvanized steel, aluminum, cast aluminum, and other alloys, as well as non-metallic materials such as carbon fiber. The length of the anchor base for a particular installation would depend upon the load the anchor 10 is to carry, the soil conditions, and the type of structure the anchor is intended to support.

The anchor base 12 has a head portion 16 and an end portion 18 that preferably terminates in a pointed tip 20. The head portion 16 is used to screw the anchor base 12 into the soil and to attach the anchor 10 to the structure. The head portion 16 has a mounting plate 22 with one or more apertures or elongated slots 24 used for passing fasteners, e.g., bolts, through the mounting plate 22 when securing the anchor 10 to the structure. The mounting plate 22 may have an opening 26 used to pass, for example, electrical wires between the opening 14 and the mounting plate opening 26, if necessary.

At or near the end portion 18 of the anchor base 12 is one or more load bearing helical plates 28 that when rotated screw the anchor 10, e.g., the helical pile, into the soil with minimal disruption to the surrounding soil. The one or more load bearing helical plates 28 on the anchor base 12 may have the same diameter, or the load bearing helical plates 28 may have different diameters that are, for example, in a tapered arrangement. For example, the tapered arrangement may be such that the smallest diameter load bearing helical plate 28 is closest to the pointed tip 20 and the largest load bearing helical plate 28 is at a distance away from the pointed tip 20. If multiple load bearing helical plates 28 are employed, the load bearing helical plates 28 on the anchor base 12 would be spaced apart at a distance sufficient to promote individual plate 28 load bearing capacity, as is known. In the embodiment of the anchor 10 of FIG. 1, a single load bearing helical plate 28 attached to the anchor base 12 is shown. The present disclosure also contemplates anchor bases 12 with multiple load bearing helical plates 28, where the distance between the load bearing helical plates 28 is preferably a multiple of the diameter of the lower load bearing helical plate.

Figure 2:
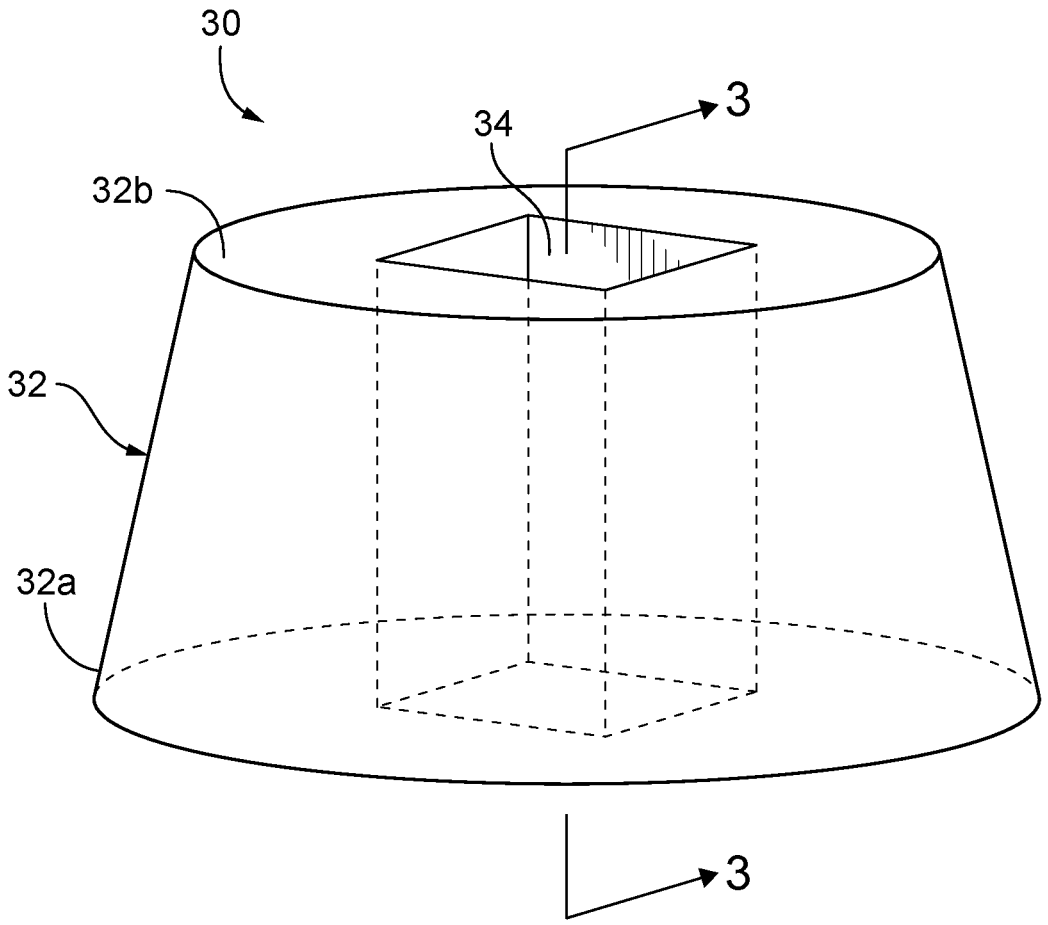
FIG. 2 is a side perspective view of an exemplary embodiment of a precast collar for the anchor of FIG. 1.
Figure 4:
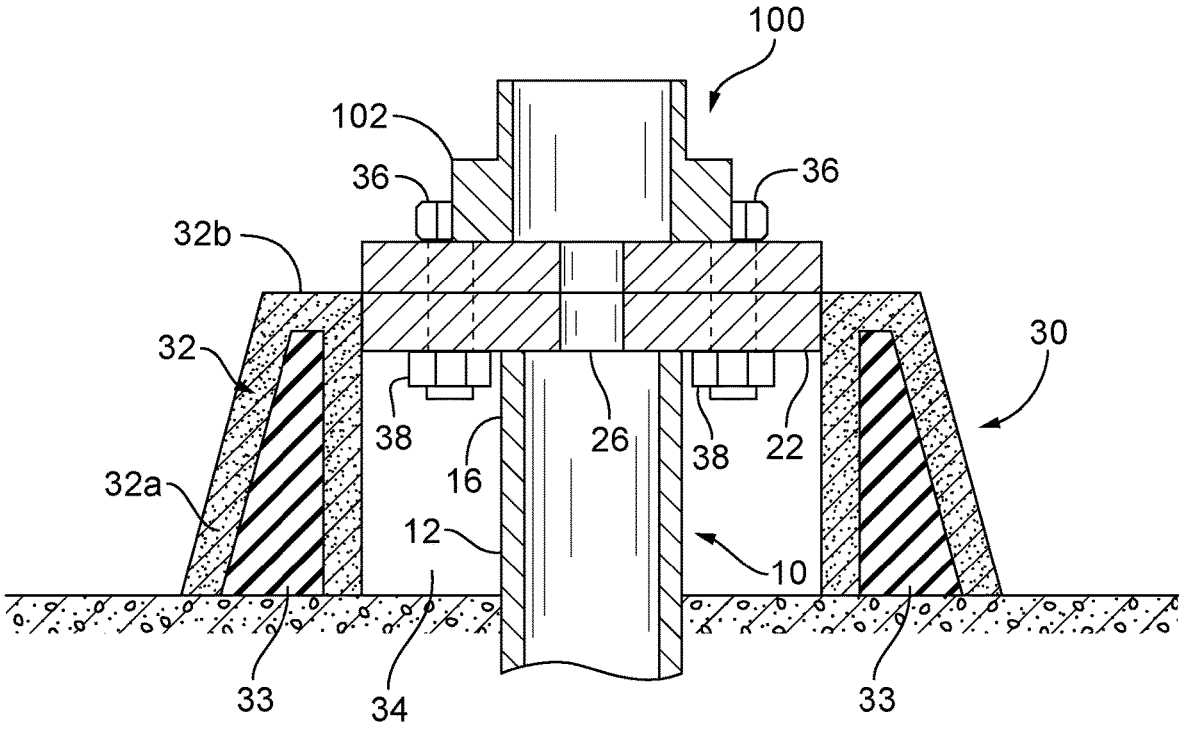
FIG. 4 is a partial cross-sectional view of an anchor of FIG. 1 and collar of FIG. 3 installed relative to the anchor and having a structure base resting on the anchor and secured to the anchor with nuts and bolts.

Referring now to FIG. 2, an exemplary embodiment of a precast collar according to the present disclosure is shown. In this embodiment, the collar 30 has a body 32 and a central opening 34. In some embodiments, the body 32 may have a weatherproof foam core 33, seen in FIG. 4, that helps reduce the weight of the collar 30. As noted above, the precast collar 30 is provided as a cover at the junction between the anchor 10 and the structure being supported. As such, the shape of the collar 30 may vary depending upon the shape and dimensions of the base of the structure, and the shape and dimensions of the mounting plate 22 of the anchor 10, seen in FIG. 1. In the embodiment shown in FIG. 2, the collar is a trapezoidal shaped disc with the larger base 32*a* configured to rest on the soil at grade as shown in FIG. 4 or below grade level as shown in for example FIG. 10. In other exemplary embodiments, the collar may be square, rectangular, cylindrical, pentagonal, octagonal or a frustum of a cone type shape. The top surface 32*b* of the collar 30 is preferably flat to provide a flat surface for the base of the structure to rest upon. The opening 34 may be square, rectangular or circular in shape and is precast into the body 32 by a molding process where a mold is formed in the shape of the intended outer shape of the collar 30, here a trapezoidal shape, and a mold insert configured to form the shape of the opening 34 is positioned in the mold at a predefined location, e.g., in the center of the mold. The mold is then filled with a material used to form the collar 30 described below. The size of the opening 34 may vary depending upon, for example, the dimensions of the mounting plate 22. For example, if the mounting plate 22 is a 12"×12" square plate, the opening would be about a 12" square opening.

Figure 3:
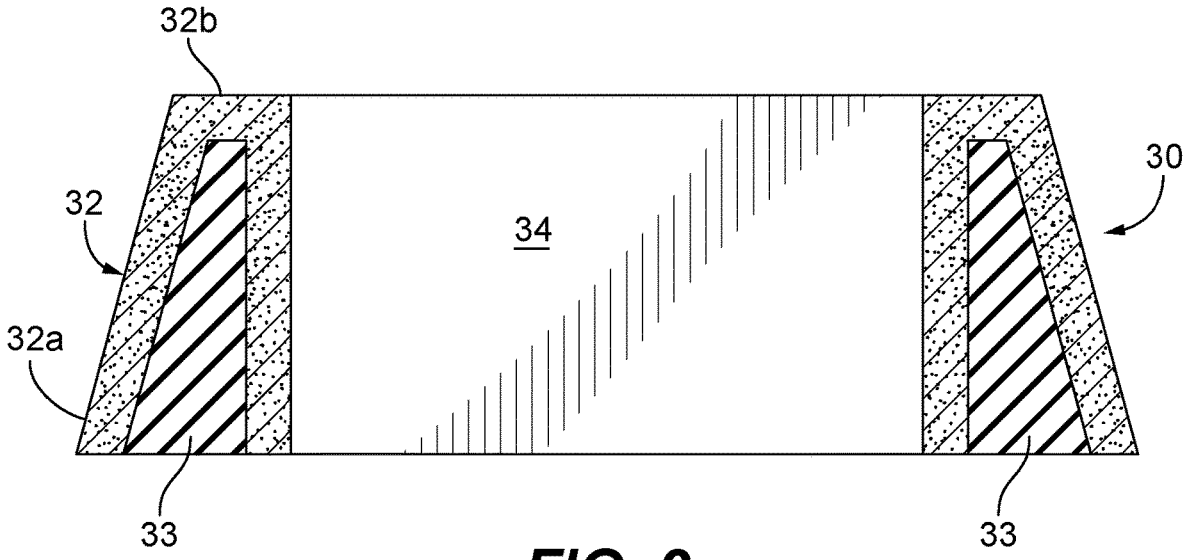
FIG. 3 is a cross-sectional view of the precast collar of FIG. 2, taken along line 3-3 of FIG. 2, illustrating the collar having a central opening.

Referring to FIGS. 3 and 4, an exemplary embodiment for covering the junction between the anchor 10 and structure 100 is shown. In this embodiment, the opening 34 of collar 30 may be sufficiently wide to permit the mounting plate 22 of the anchor 10 to pass through the opening 34 so that a base 102 of the structure 100 can rest on and be directly secured to the mounting plate 22 so that the anchor 10 supports the load. In this exemplary embodiment, the collar 30 is a decorative collar configured to hide the junction between the anchor 10 and the base 102 of the structure 100 and does not carry any of the load of the structure 100.

Figure 5:
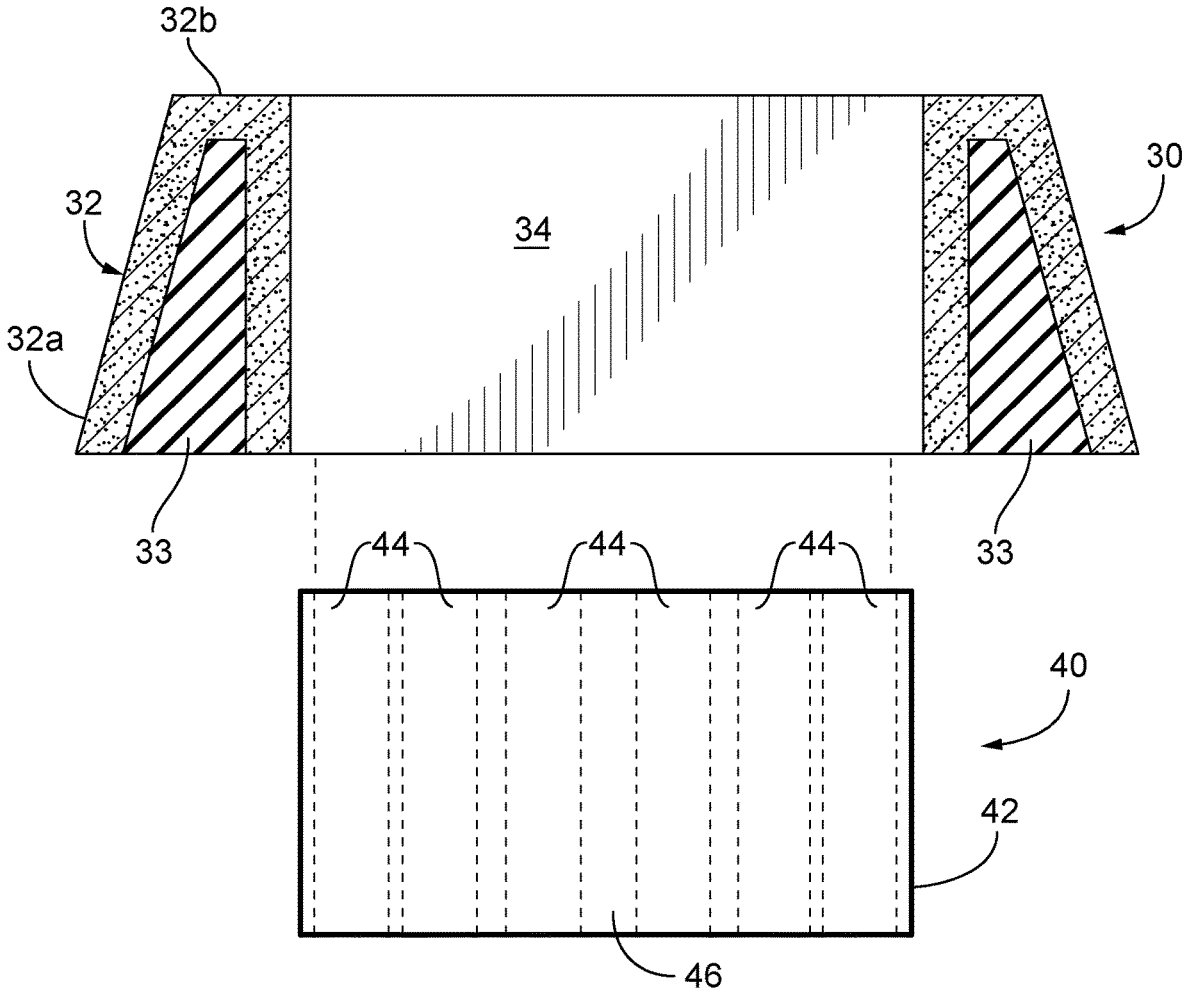
FIG. 5 is a side view of the precast collar of FIG. 2, illustrating the collar having a central opening that receives an insert.
Figure 6:
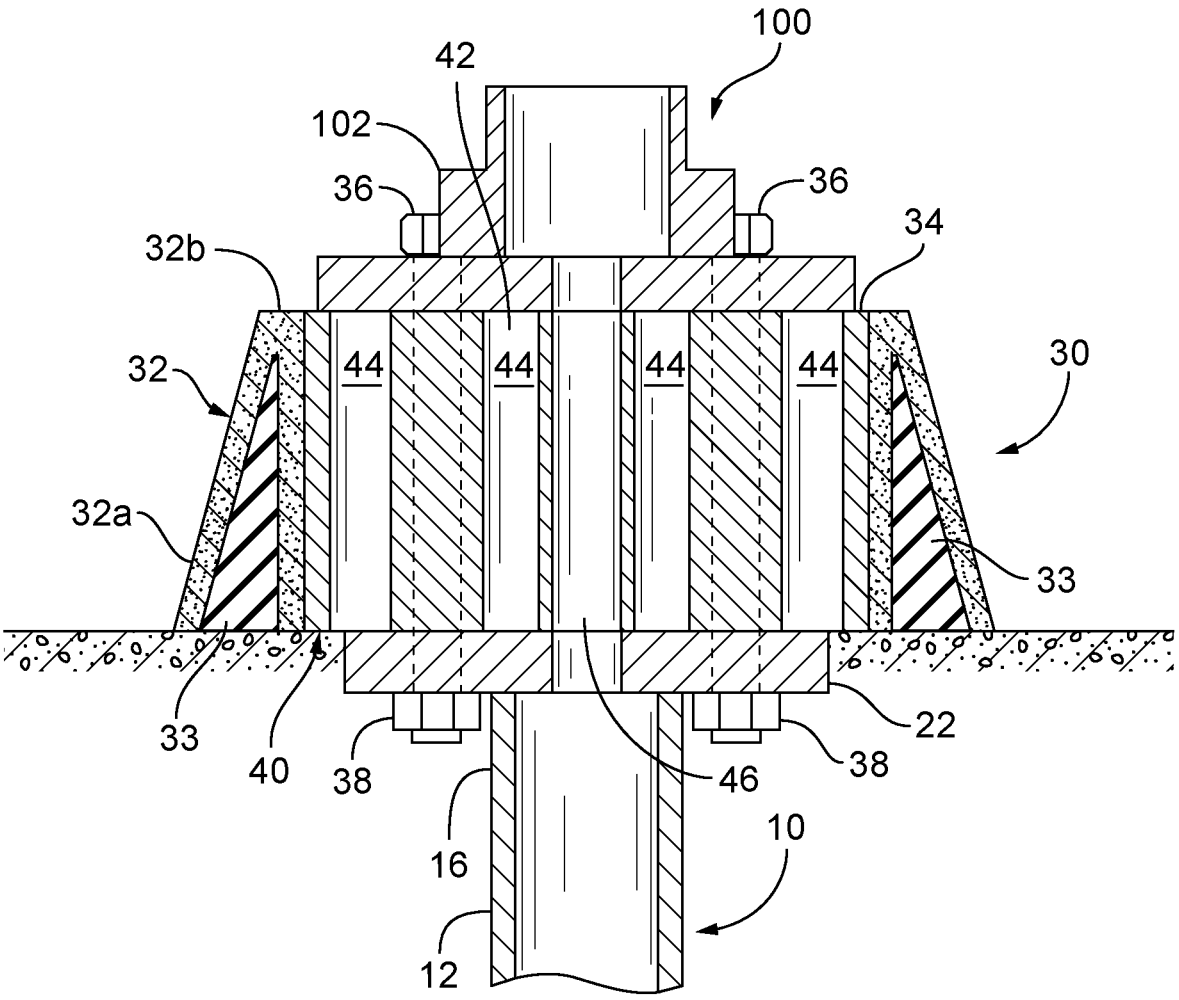
FIG. 6 is a partial cross-sectional view of the collar and insert of FIG. 5 installed relative to the anchor of FIG. 1 and having a structure base on the insert and secured to the anchor with nuts and bolts.

Referring to FIGS. 5 and 6, since the collar 30 is a precast collar, it may be more economically efficient to create a single collar type that preferably has an opening 34 configured to accommodate the largest contemplated structure that the anchor 10 is intended to support. An insert 40 can then be used to effectively reduce the size of the opening 34 to accommodate smaller structures. In this exemplary embodiment, the collar 30 is fabricated with a wide opening 34. The collar 30 may include an insert 40 that fits within the opening 34, as shown. The insert 40 has a body 42 and a plurality of apertures 44 that permit fasteners, e.g., bolts, to pass through the insert 40. The insert 40 may also include a channel 46 through which objects, such as electrical wires, can pass through the insert 40. The insert 40 may be fabricated from a rigid material capable of passing the load from the structure 100 to the anchor 10. Examples of such suitable material include steel and galvanized steel.

As shown in FIG. 6, the collar 30 can be placed on the ground around the mounting plate 22 and the insert 40 can be placed on the mounting plate 22 of the anchor 10. The base 102 of a structure 100, e.g., the base of a street light pole, can then be placed on the insert 40. Bolts 36 can be passed through mounting holes in the base 102 of the structure 100, through the relevant apertures 44 in the insert 40, and through the apertures 24 in the mounting plate 22. Nuts 38 are then threaded onto the bolts 36 and tightened to secure the structure 100 to the anchor 10 with a decorative collar 30 covering the junction between the anchor 10 and the structure 100.

Figure 7:
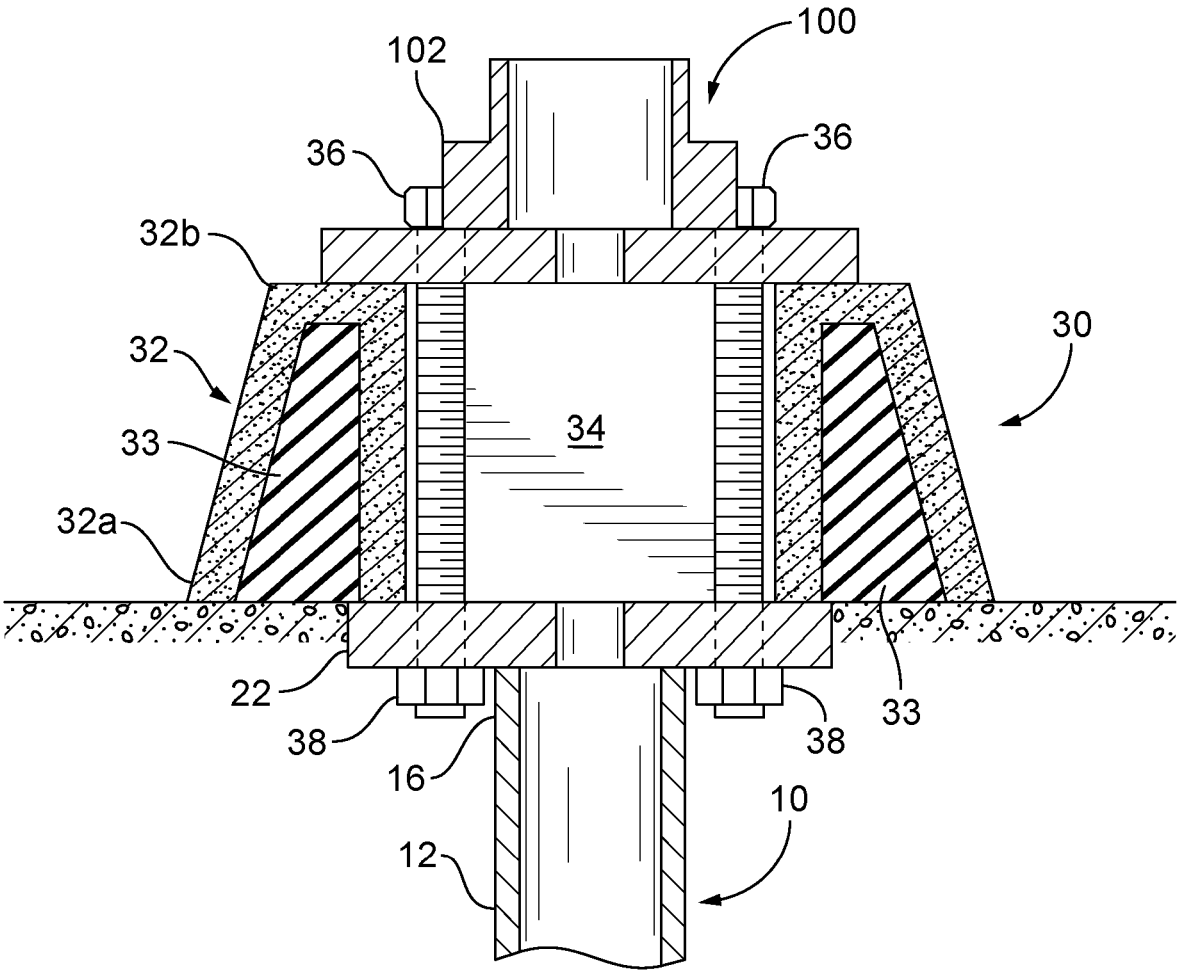
FIG. 7 is a partial cross-sectional view of the collar of FIG. 2 installed relative to the anchor of FIG. 1 and having a structure base on the collar and secured to the anchor with nuts and bolts.

Referring to FIG. 7, another exemplary embodiment for covering the junction between the anchor 10 and structure 100 is shown. In this embodiment, the opening 34 may be sufficiently wide to provide a passage between the mounting plate 22 and the base 102 of the structure 100. The opening permits, for example, electrical wires to pass between the structure 100 and the anchor 10, and permits fasteners 36, such as bolts or any other suitable fastener, to pass through the base 102 of the structure 100, through the opening 34 in the collar 30, and through the elongated slots or apertures 24 in mounting plate 22 of anchor 10 so that the structure 100 may be secured to the anchor 10 using the bolts 36 and nuts 38.

Figure 8:
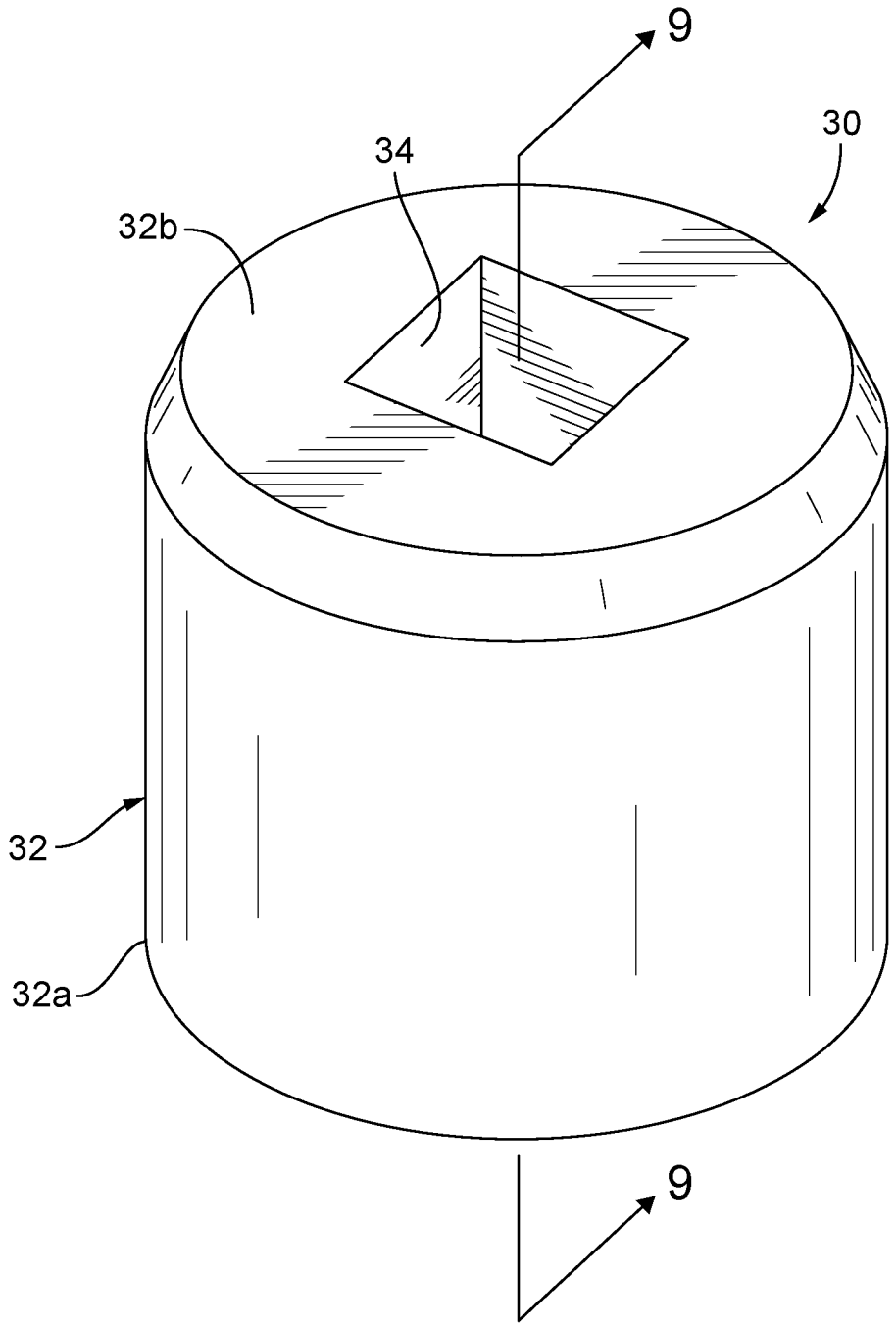
FIG. 8 is a top perspective view of another exemplary embodiment of a precast collar for the anchor of FIG. 1.
Figure 9:
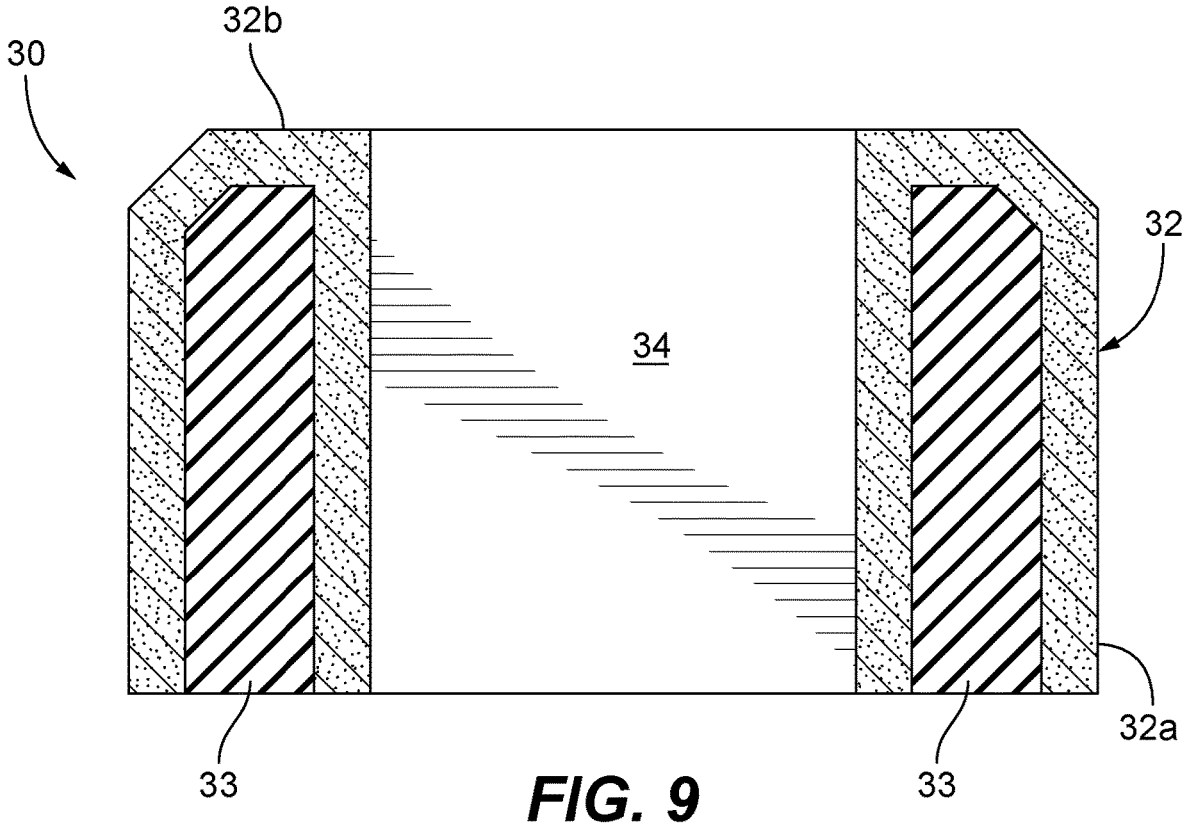
FIG. 9 is a cross-sectional view of the precast collar of FIG. 8, taken along line 9-9 of FIG. 8, illustrating the collar having a central opening.
Figure 10:
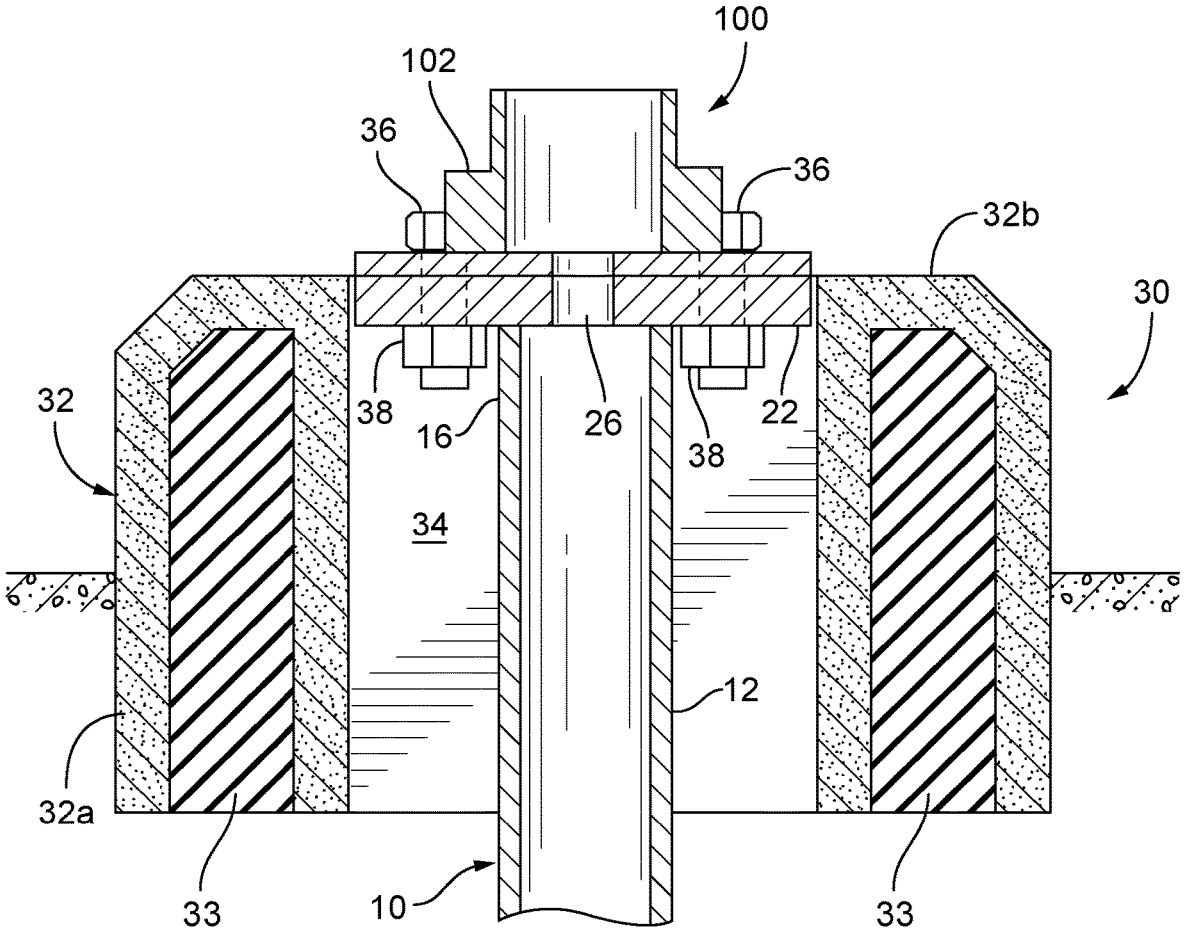
FIG. 10 is a partial cross-sectional view of an anchor of FIG. 1 and collar of FIG. 9 installed relative to the anchor and having a structure base resting on the anchor and secured to the anchor with nuts and bolts.

Referring to FIGS. 8-10, another exemplary embodiment of a collar 30 according to the present disclosure is shown. In this exemplary embodiment, the collar 30 is a cylindrical collar having a body 32 and an opening 34. However, as noted above, the shape of the collar 30 may vary depending upon the shape and dimensions of the base 102 of the structure 100, and the shape and dimensions of the mounting plate 22 of the anchor 10. For example, square, rectangular, cylindrical, pentagonal, octagonal or a frustum of a cone type shape. Further, to remove sharp edges from the collar 30, the edges of the collar 30 may be rounded, beveled, etc. In addition, one or more outer surfaces of the collar 30 may be molded with, stamped with or otherwise include a logo to distinguish, for example, the location where the collar 30 is installed, or otherwise include a manufacturer or the like.

The opening 34 in the collar 30 may be sufficiently wide to permit the mounting plate 22 of the anchor 10 to pass through the opening 34 so that a base 102 of the structure 100 can rest on and be directly secured to the mounting plate 22. The structure 100 would be secured to the anchor 10 using bolts 36 and nuts 38. In this exemplary embodiment, the collar 30 is a decorative collar configured to hide the junction between the anchor 10 and the base 102 of the structure 100 and does not carry any of the load of the structure 100.

Figure 11:
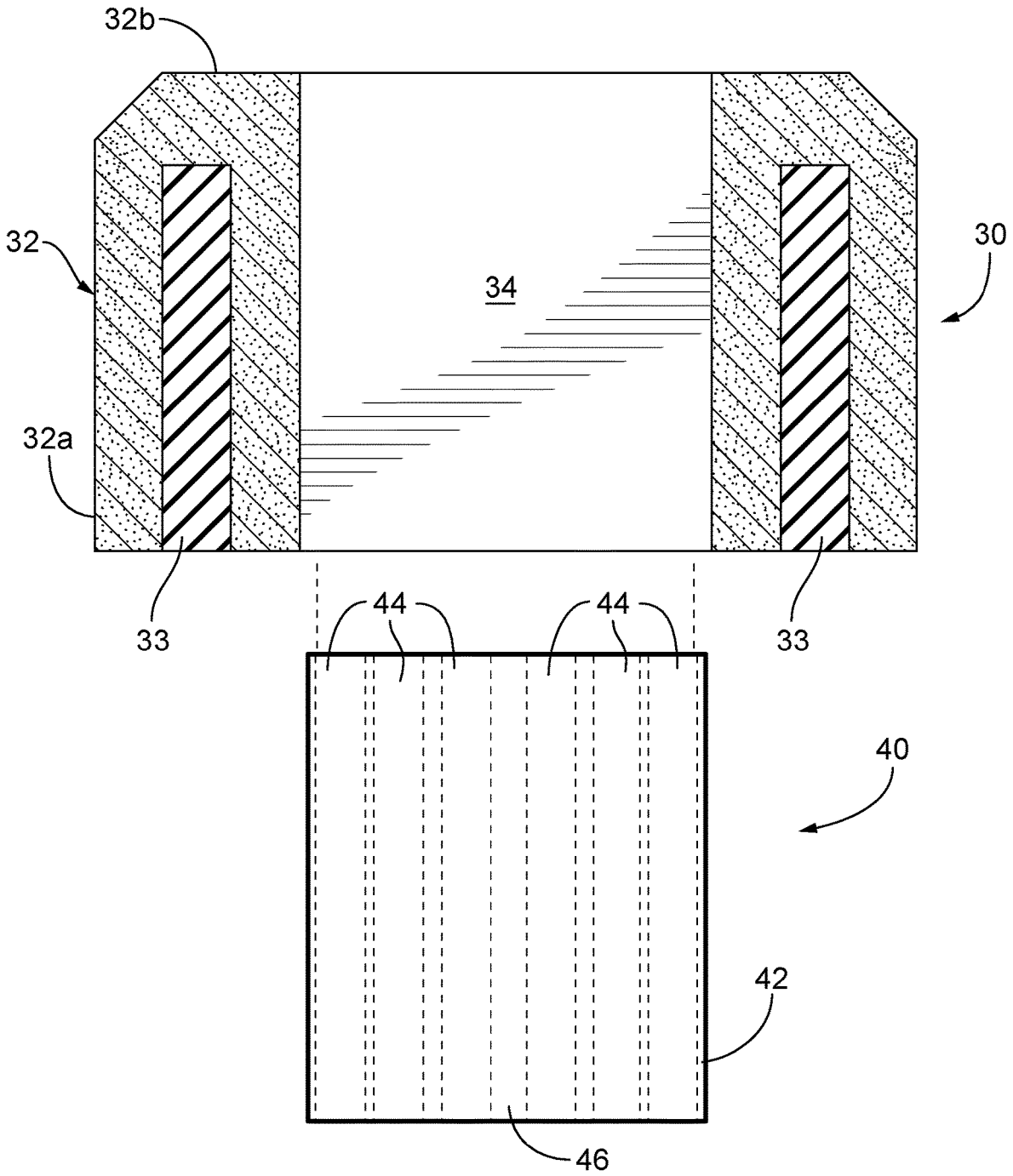
FIG. 11 is a side view of the precast collar of FIG. 8, illustrating a collar having a central opening that receives an insert.
Figure 12:
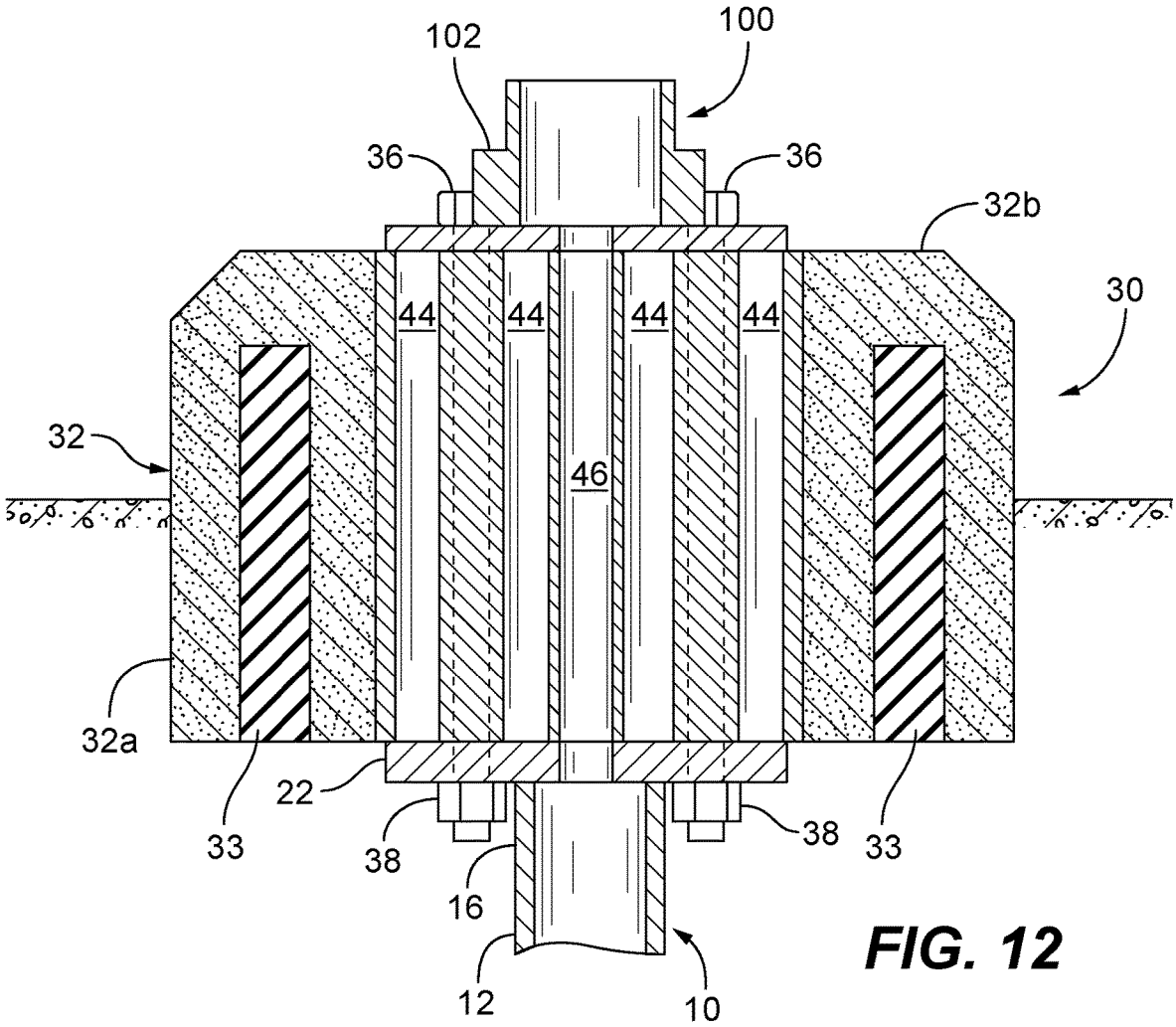
FIG. 12 is a partial cross-sectional view of the collar and insert of FIG. 11 installed relative to the anchor of FIG. 1 and having a structure base on the insert and secured to the anchor with nuts and bolts.

Referring now to FIGS. 8, 11 and 12, another exemplary embodiment of a collar 30 according to the present disclosure is shown. In this exemplary embodiment, the collar 30 is also a cylindrical collar having a body 32 and an opening 34. As noted above, since the collar 30 is a precast collar, it may be more economically efficient to create a single collar type that preferably has an opening 34 configured to accommodate the largest contemplated structure that the anchor 10 is intended to support. An insert 40 can then be used to effectively reduce the size of the opening 34 to accommodate smaller structures.

In one exemplary embodiment shown in FIGS. 11 and 12, the collar 30 is fabricated with a wide opening 34. The collar 30 may include an insert 40 that fits within the opening 34 as shown. The insert 40 has a body 42 and a plurality of apertures 44 that permit fasteners, e.g., bolts 36, to pass through the insert 40. The insert 40 may also include a channel 46 through which objects, such as electrical wires, can pass through the insert 40. The insert 40 may be fabricated from a rigid material capable of passing the load from the structure 100 to the anchor 10. Examples of such suitable material include steel, and galvanized steel.

As shown in FIG. 12, the collar 30 can be placed on or in the ground around the mounting plate 22 and the insert 40 can be placed on the mounting plate 22 of the anchor 10. The base 102 of a structure 100, e.g., the base of a street light pole, can then be placed on the insert 40. Bolts 36 can be passed through mounting holes in the base 102 of the structure 100, through the relevant apertures 44 in the insert 40, and through the apertures 24 in the mounting plate 22. Nuts 38 are then threaded onto the bolts 36 and tightened to secure the structure 100 to the anchor 10.

Figure 13:
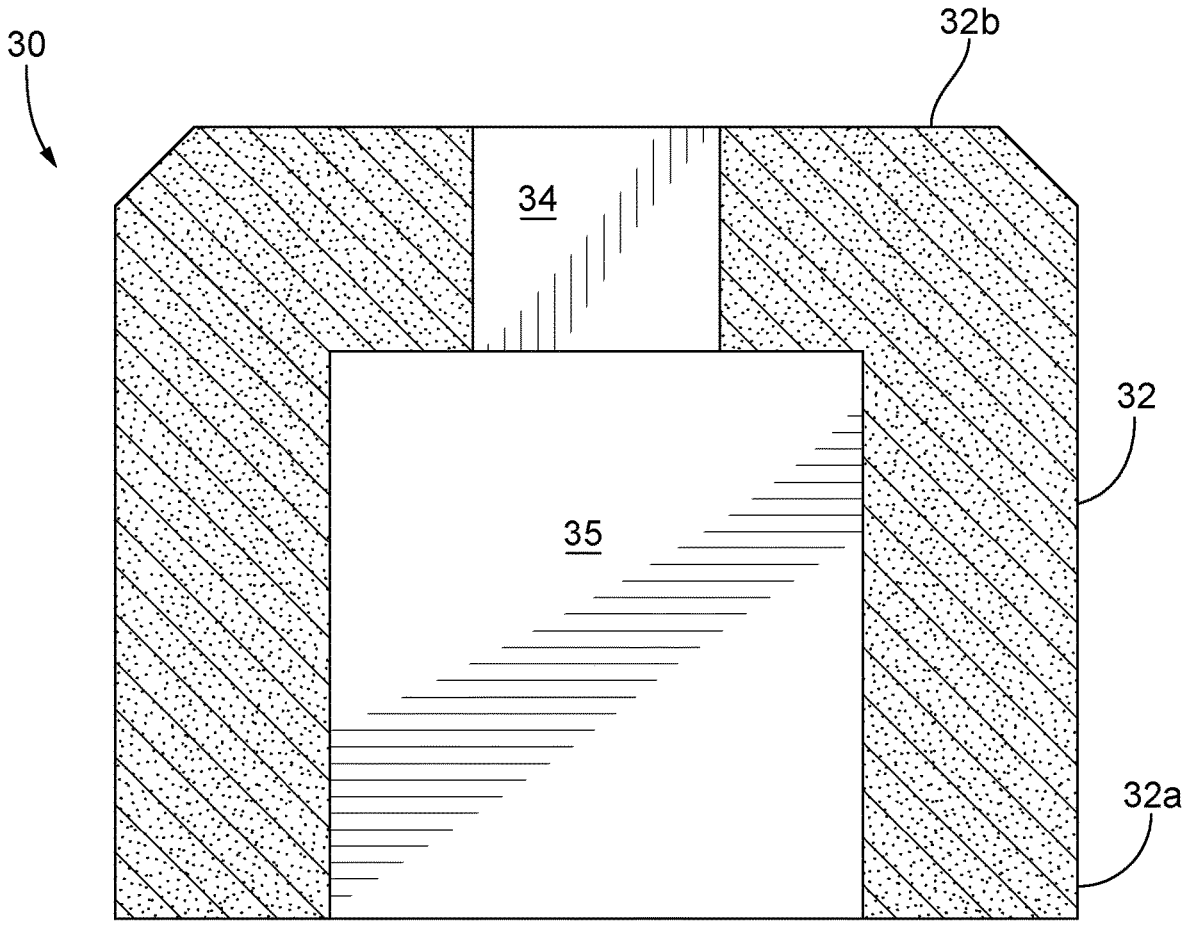
FIG. 13 is a cross-sectional view of another exemplary embodiment of the collar of FIG. 8.
Figure 14:
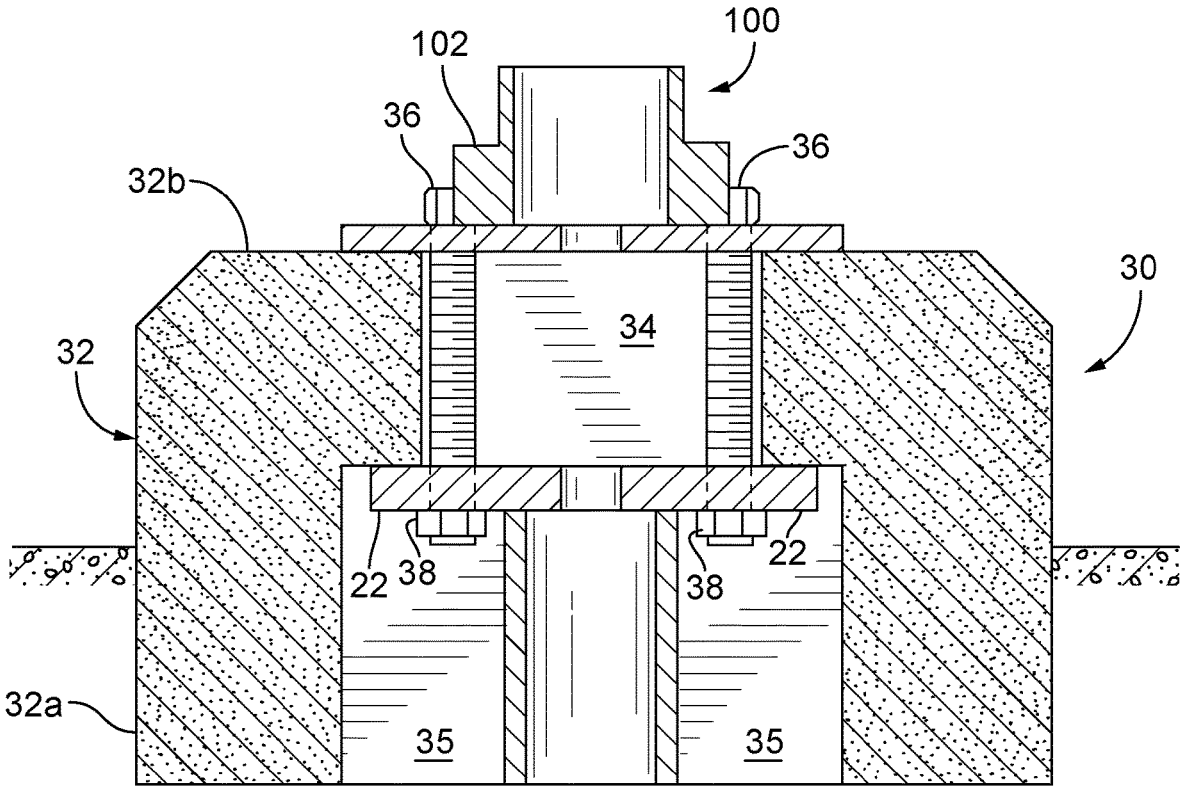
FIG. 14 is a partial cross-sectional view of an anchor FIG. 1 and collar of FIG. 13 installed relative to the anchor and having a structure base resting on the collar and secured to the anchor with nuts and bolts.

Referring to FIGS. 13 and 14, another exemplary embodiment for covering the junction between the anchor 10 and structure 100 is shown. In this embodiment, the collar 30 includes two openings 34 and 35. The first opening 34 is narrower than the second opening 35. In this embodiment, the mounting plate 22 rests within the second opening 35, as shown. The first opening 34 may be sufficiently wide to provide a passage between the mounting plate 22 and the base 102 of the structure 100 so that, for example, electrical wires can pass between the structure and the anchor 10. The first opening 34 may also be sufficiently wide to permit fasteners, such as bolts 36, to pass through the base 102 of the structure 100, through the opening 34, and through the apertures 24 in mounting plate 22 of anchor 10. As a result, the base 102 of the structure 100 may rest on the top surface **32*b* of the collar body 32, and the bolts 36 can then be secured to the mounting plate 22 using nuts 38**.

Figure 15:
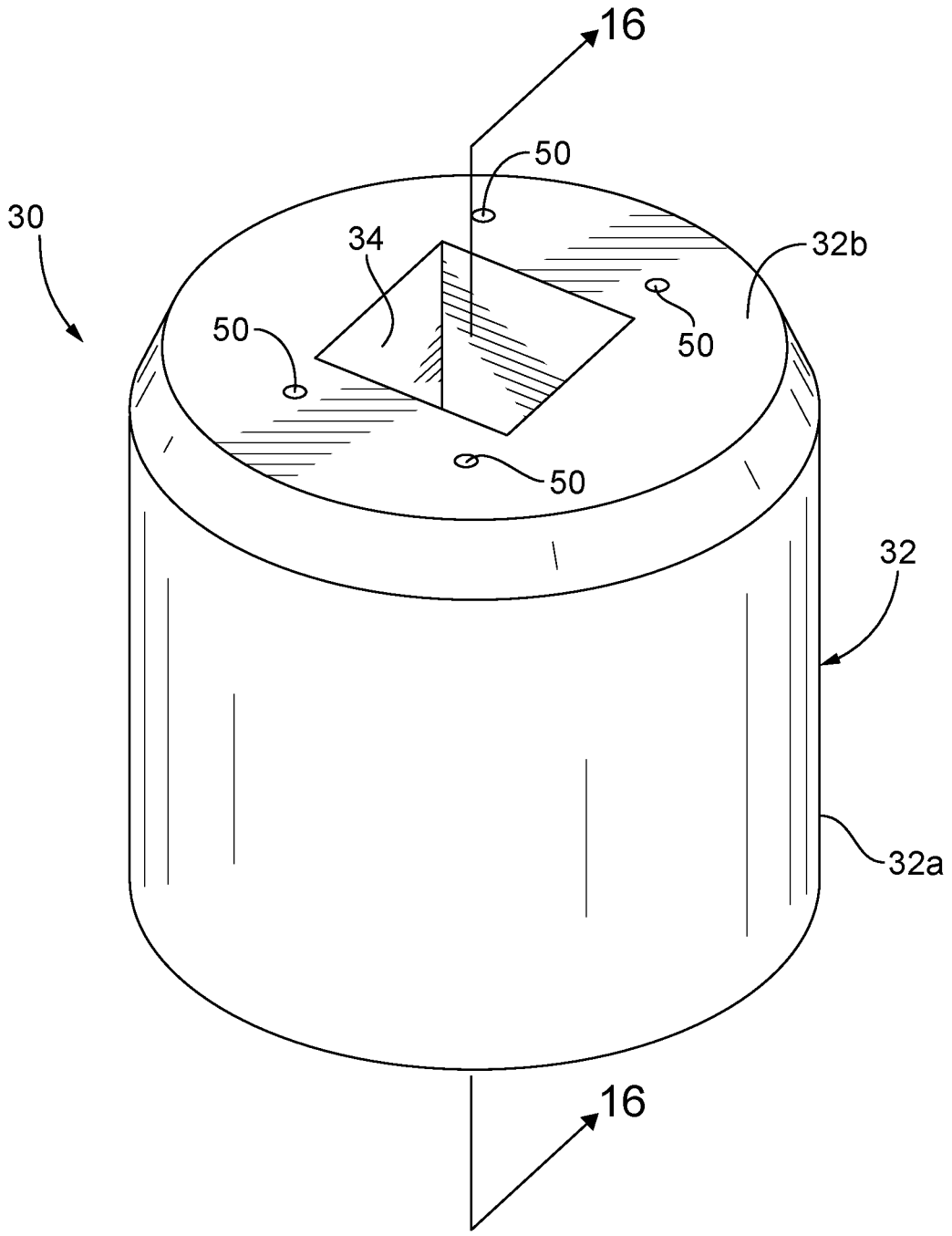
FIG. 15 is a top perspective view of another exemplary embodiment of a precast collar for the anchor of FIG. 1.
Figure 16:
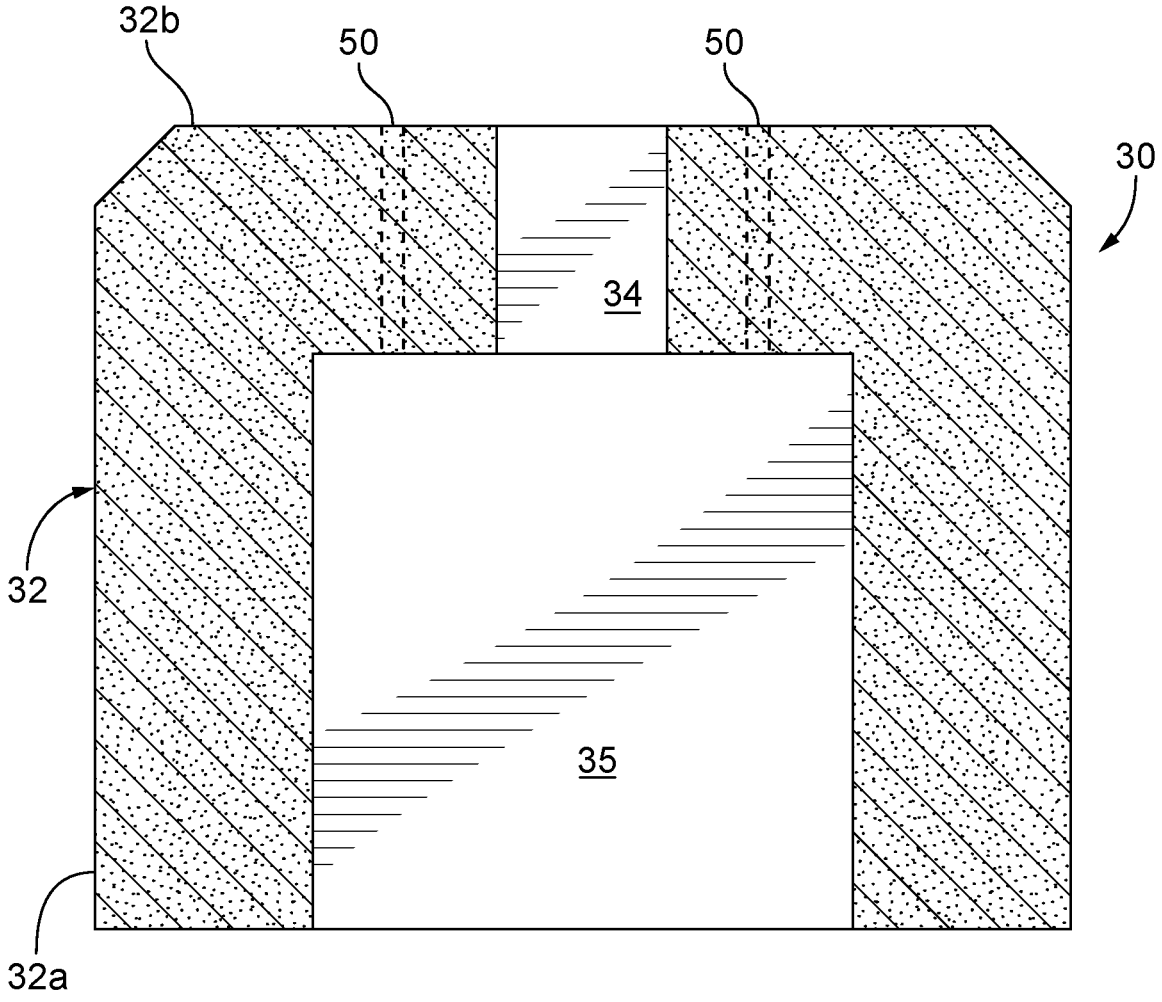
FIG. 16 is a cross-sectional view of the collar of FIG. 15 taken along line 16-16 of FIG. 15.
Figure 17:
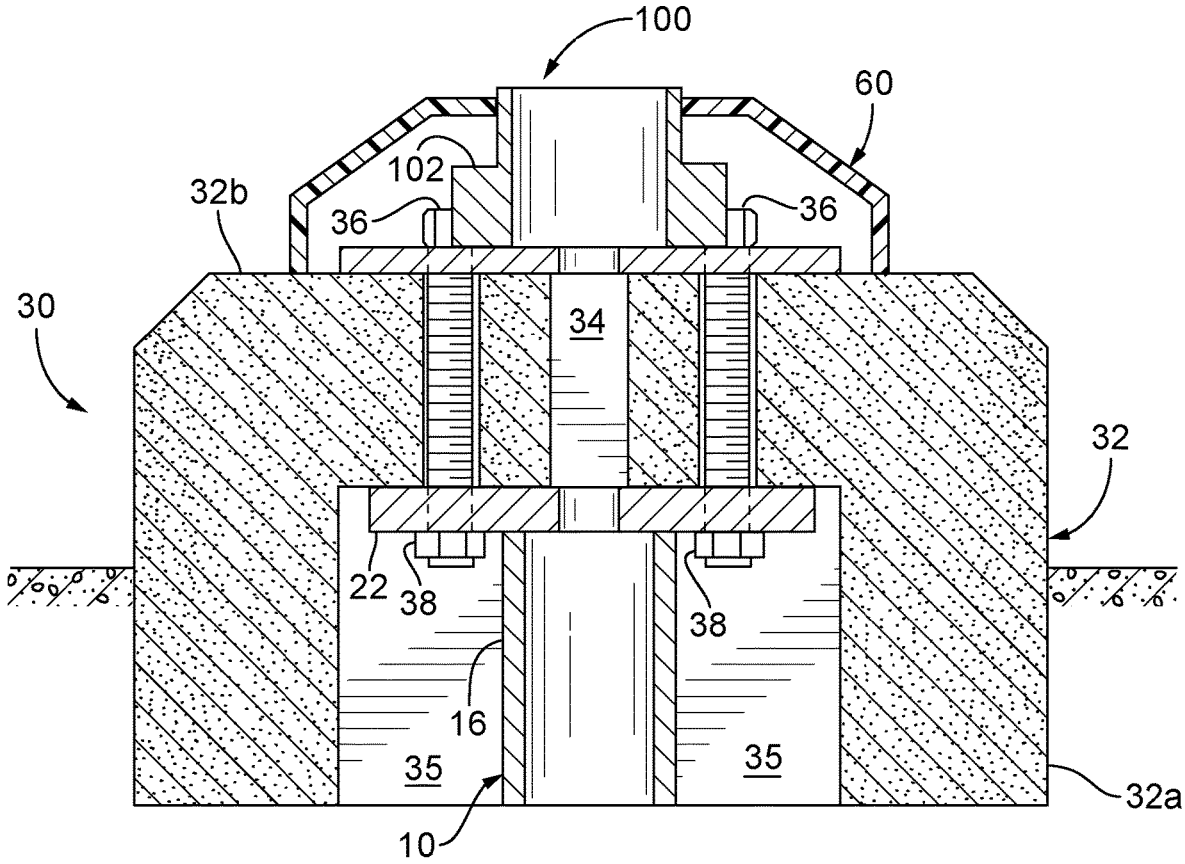
FIG. 17 is a partial cross-sectional view of an anchor FIG. 1 and collar of FIG. 16 installed relative to the collar and having a structure base resting on the collar and secured to the anchor with nuts and bolts, and illustrating a protective elastomeric cover around the base of the structure.

Referring to FIGS. 15-17, another exemplary embodiment for covering the junction between the anchor 10 and structure 100 is shown. In this embodiment, the collar 30 also includes the two openings 34 and 35. In this embodiment, the second opening 35 is configured to receive the mounting plate 22, as shown in FIG. 17. The first opening 34 is narrower than the second opening 35 but is sufficient to provide a passage between the mounting plate 22 and the base 102 of the structure 100 so that, for example, electrical wires can pass between the structure and the anchor 10 but cannot pass the fasteners 36, such as bolts or other types of fasteners. To pass the fasteners 36 between the top surface **32*b* of the collar 32 and the second opening 35, the collar body 32 may include apertures 50 that permit the fasteners 36 to pass through the base 102 of the structure 100, through the apertures 50 in the collar body 32 and through the apertures 24 in mounting plate 22 of anchor 10. As a result, the base 102 of the structure 100 may rest on the top surface 32*b* of the collar body 32, and the bolts 36 can then be secured to the mounting bracket or plate 22 using nuts 38. To minimize the effects of environmental conditions, a weather resistant protective cover 60 may be placed around the base 102 of the structure 100 and the top surface 32*b* of the collar 30. The protective cover 60** may be made of an elastomeric material, such as rubber.

In each of the embodiments described above, the collar 30 is a precast collar that can be fabricated from various lightweight, rigid materials. In one exemplary embodiment, the collar may be fabricated from a Quazite polymer concrete and other light-weight variants of a Quazite polymer concrete. In another exemplary embodiment, the collar may be fabricated from a rigid, durable, high strength, low permeability material that can withstand environmental conditions and if necessary support at least a portion of the weight of the structure 100 being supported by the anchor 10. An example of a suitable material is Stuccomax™ manufactured by Gigacrete,™ Inc. of Las Vegas, Nev., U.S.A., which is a high strength non-Portland cement, natural limestone sand based composite that may include calcium sulfoaluminate, calcium carbonate, modifiers, and fiber mesh. To further reduce the weight of the collar 30, a weatherproof foam core 33, seen in FIGS. 3 and 9, may be embedded in the collar to reduce the weight of the collar and increase the structural integrity of the collar. Other examples of suitable materials include a durable, corrosive resistant, high strength, low permeability concrete, such as polymer concrete, reinforced concrete, such as fiberglass reinforced concrete, concrete, carbon fiber materials and/or hard plastic materials.

Figure 18:
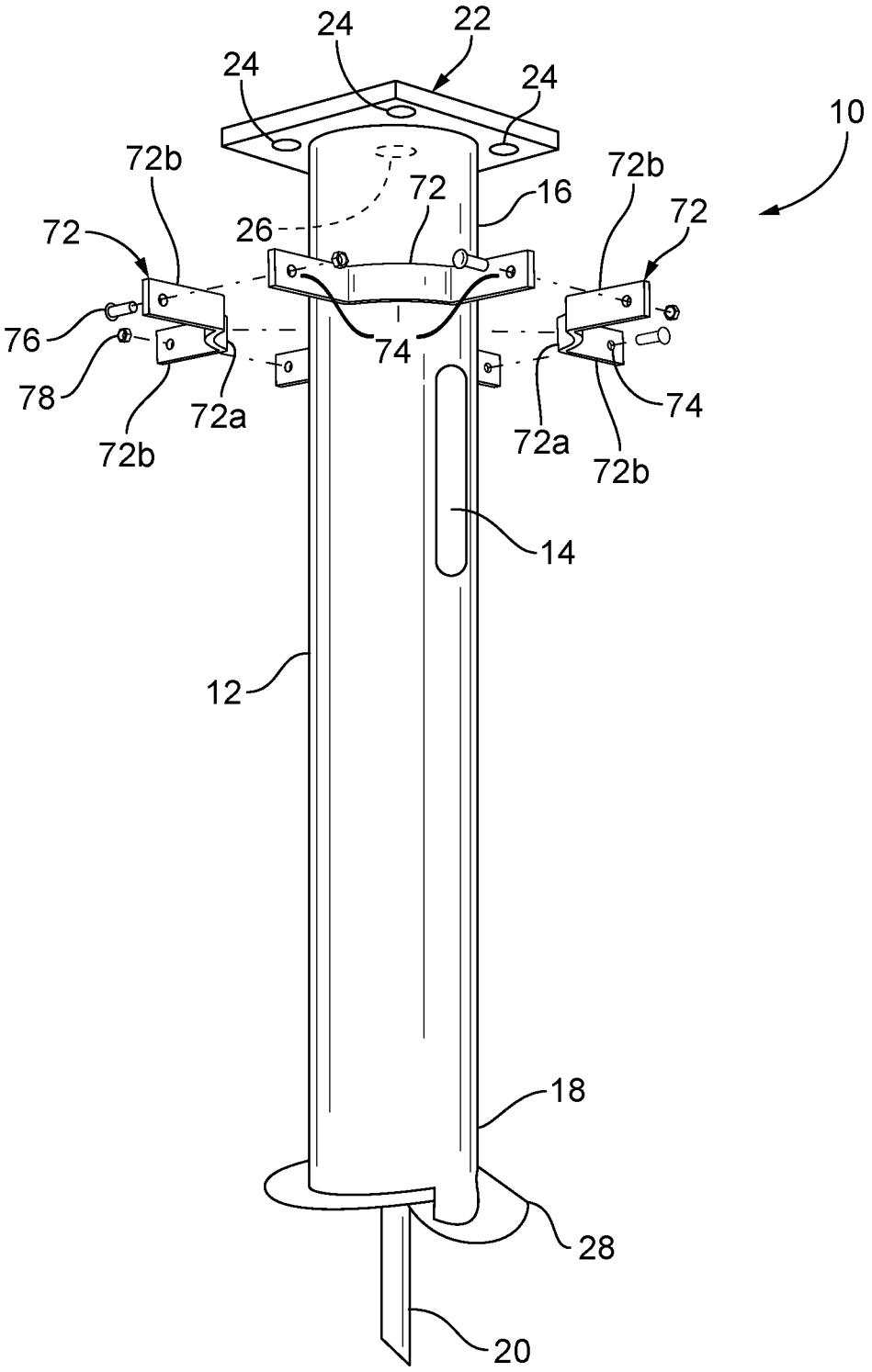
FIG. 18 is a side perspective view of another exemplary embodiment of an anchor for supporting a structure, illustrating an anchor clamp used to support a collar.
Figure 19:
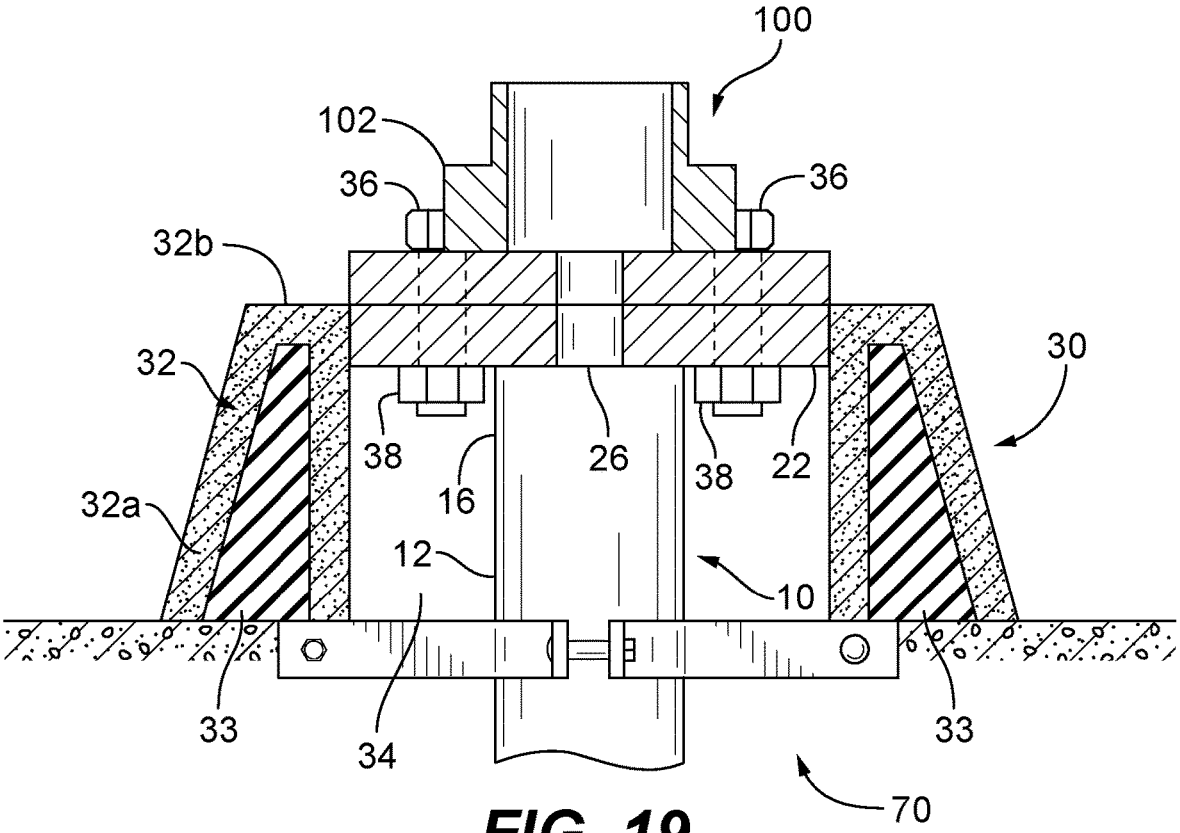
FIG. 19 is a partial cross-sectional view of an anchor of FIG. 1 and collar of FIG. 3 installed on the ground at grade level, illustrating a structure base resting on the anchor and secured to the anchor with nuts and bolts and the anchor clamp of FIG. 18 supporting the base of the collar.

Referring now to FIGS. 18 and 19, an exemplary embodiment of anchor clamp 70 according to the present disclosure is shown. The anchor clamp 70 is used to support the collar 30 so that the collar does not sink in the ground exposing the junction between the base 102 of the structure 100 and the mounting plate 22 of the anchor base 12, as shown in FIG. 19. The anchor clamp 70 is configured to be secured to the anchor 10 a distance from the mounting plate 22 sufficient to support the collar 30 in a fixed relationship with the anchor base 12. In one exemplary embodiment, the anchor clamp 70 has a plurality of clamp members 72, each having an anchor mating face 72*a* and a pair of clamp arms 72*b* extending from the mating face 72*a* as shown in FIG. 18. Each clamp arm 72*b* includes an aperture 74 used to secure one clamp arm 72*b* to a clamp arm 72*b* of another clamp member 72 using bolts 76 and nuts 78. In another exemplary embodiment, the bottom surface of the collar 30 may include one or more grooves or channels (not shown) in which the clamp arms 72*b* can rest when the collar 30 is supported by the anchor clamp 70. Having the clamp arms rest in the grooves or channels prevents rotation of the collar 30 relative to the anchor base 12.

Figure 20:
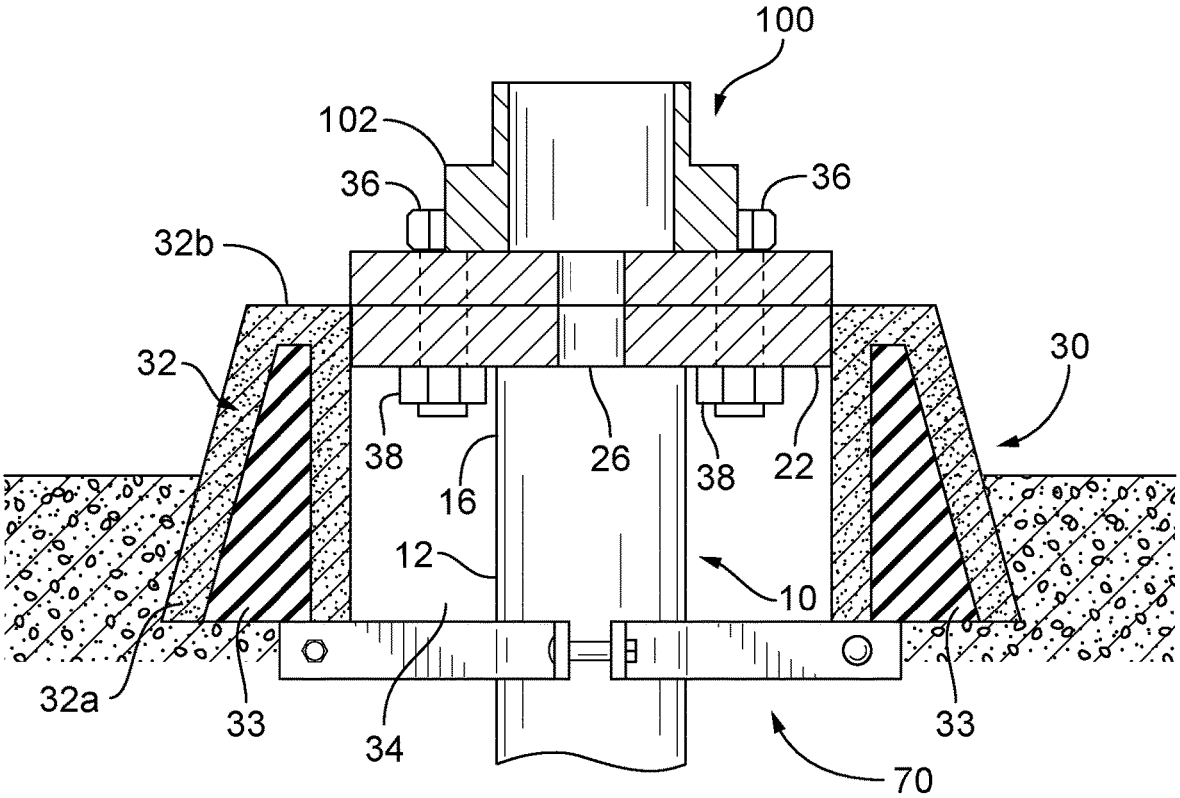
FIG. 20 is a partial cross-sectional view of an anchor of FIG. 1 and collar of FIG. 3 installed on the ground partially below grade level, illustrating a structure base resting on the anchor and secured to the anchor with nuts and bolts and the anchor clamp of FIG. 18 supporting the base of the collar.

In operation, and referring to FIG. 19, a collar 30 of the embodiment of FIG. 3 is positioned at grade so that the mounting plate 22 of the anchor 10 is within opening 34. In this example, the anchor clamp 70 is secured to the anchor base 12 at a point at grade level as shown. In operation, and referring to FIG. 20, a collar 30 of the embodiment of FIG. 3 is positioned partially below grade so that the mounting plate 22 of the anchor base 12 is within opening 34. In this example, the anchor clamp 70 is secured to the anchor base 12 at a point below grade level as shown.

While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

What is claimed is:

1. A collar for an anchor, the collar comprising:

a body having a top surface and a bottom surface, the body being made of a high strength natural limestone sand-based composite or a light-weight polymer concrete, and a foam core;

a central opening in the body extending from the top surface of the body to the bottom surface of the body and having one or more perimeter walls; and an insert having a top surface, a bottom surface and one or more perimeter walls, the insert being configured to fit within the central opening and substantially occupy all of the central opening so that the top surface of the insert is aligned with the top surface of the body, the bottom surface of the insert is aligned with the bottom surface of the body and the one or more perimeter walls of the insert are adjacent the one or more perimeter walls of the body, the insert including a plurality of apertures extending from the top surface of the insert to the bottom surface of the insert that permit fasteners to pass through the insert, and the bottom surface of the insert being configured to rest on a mounting plate of the anchor.

2. The collar according to claim 1, wherein the insert further comprises at least one channel through which one or more objects can pass from the top surface of the insert to the bottom surface of the insert.

3. The collar according to claim 1, wherein the insert is fabricated from a rigid material that can pass a load on the top surface of the insert to the bottom surface of the insert.

4. The collar according to claim 3, wherein the rigid material comprises steel and galvanized steel.

5. The collar according to claim 1, wherein the light-weight polymer concrete comprises a Quazite polymer concrete.

6. The collar according to claim 1, wherein the body has one of a trapezoidal shape, a cylindrical shape, an octagonal shape, a square shape, a rectangular shape, a pentagonal shape or a frustum of a cone shape.

7. An anchor kit comprising:

a screw type anchor;

a collar comprising a body made of a light-weight polymer concrete and a weatherproof foam core, the body having a central opening to receive a mounting plate of the screw type anchor; and an anchor clamp that can be secured to the screw type anchor, wherein the anchor clamp is configured to support the collar so that the collar is in a fixed relationship relative to the screw type anchor.

8. The anchor kit according to claim 7, wherein the light-weight polymer concrete comprises a Quazite polymer concrete.

9. The anchor kit according to claim 7, wherein the body has one of a trapezoidal shape, a cylindrical shape, an octagonal shape, a square shape, a rectangular shape, a pentagonal shape or a frustum of a cone shape.

10. The anchor kit according to claim 7, wherein the screw type anchor comprises a helical pile.

11. The anchor kit according to claim 10, wherein the helical pile includes a single helical plate or a plurality of helical plates.

12. An anchor kit comprising:

a screw type anchor; and a collar comprising:

a body having a top surface and a bottom surface, the body being made of a high strength natural limestone sand-based composite or a light-weight polymer concrete, and a foam core;

a central opening in the body extending from the top surface of the body to the bottom surface of the body and having one or more perimeter walls; and an insert having a top surface, a bottom surface and one or more perimeter walls, the insert being configured to fit within the central opening and substantially occupy all of the central opening so that the top surface of the insert is aligned with the top surface of the body, the bottom surface of the insert is aligned with the bottom surface of the body and the one or more perimeter walls of the insert are adjacent the one or more perimeter walls of the body, the insert including a plurality of apertures extending from the top surface of the insert to the bottom surface of the insert that permit fasteners to pass through the insert, and the bottom surface of the insert being configured to rest on a mounting plate of the anchor.

13. The anchor kit according to claim 12, wherein the insert further comprises at least one channel through which one or more objects can pass from the top surface of the insert to the bottom surface of the insert.

14. The anchor kit according to claim 12, wherein the insert is fabricated from a rigid material that can pass a load on the top surface of the insert to the bottom surface of the insert.

15. The anchor kit according to claim 14, wherein the rigid material comprises steel and galvanized steel.

16. The anchor kit according to claim 12, wherein the light-weight polymer concrete comprises a Quazite polymer concrete.

17. The anchor kit according to claim 12, wherein the body has one of a trapezoidal shape, a cylindrical shape, an octagonal shape, a square shape, a rectangular shape, a pentagonal shape or a frustum of a cone shape.

18. The anchor kit according to claim 12, further comprising an anchor clamp that can be secured to the screw type anchor, wherein the anchor clamp is configured to support the collar so that the collar is in a fixed relationship relative to the screw type anchor.

19. The anchor kit according to claim 12, wherein the screw type anchor comprises a helical pile.

20. The anchor kit according to claim 19, wherein the helical pile includes a single helical plate or a plurality of helical plates.

* * * * *